United States Patent [19]

Carlsson

[11] 4,113,103

[45] Sep. 12, 1978

[54] OPENING ARRANGEMENT FOR PACKING CONTAINERS

[75] Inventor: Lars Christer Carlsson, Blentarp, Sweden

[73] Assignee: Tetra Pak International AB, Lund, Sweden

[21] Appl. No.: 808,690

[22] Filed: Jun. 21, 1977

[30] Foreign Application Priority Data

Jul. 8, 1976 [SE] Sweden ..... 7607803

[51] Int. Cl.[2] ..... B65D 5/54

[52] U.S. Cl. ..... 206/611; 206/630; 229/7 R

[58] Field of Search ..... 229/7 R, 17 R, 7 S, 229/17 G, 14 BL, 14 BA; 206/630, 607, 611, 626

[56] References Cited

U.S. PATENT DOCUMENTS

| | | | |
|---|---|---|---|
| 2,549,048 | 4/1951 | Bergstein | 229/17 R |
| 2,730,288 | 1/1956 | Dixon | 229/17 G |
| 2,731,188 | 1/1956 | Alden | 229/17 G |
| 2,870,935 | 1/1959 | Houghtelling | 229/7 R |
| 3,101,879 | 8/1963 | Meyer-Jagenberg | 229/7 R |
| 3,127,082 | 3/1964 | Meyer-Jagenberg | 229/7 R |
| 3,355,059 | 11/1967 | Balocca et al. | 229/7 R |
| 3,387,763 | 6/1968 | Koolnis | 229/17 R |
| 3,580,478 | 5/1971 | Bemiss | 206/607 |
| 3,768,719 | 10/1973 | Johnson | 229/7 R |
| 3,883,034 | 5/1975 | Rausing | 229/7 R |

*Primary Examiner*—Stephen P. Garbe

*Attorney, Agent, or Firm*—Burns, Doane, Swecker & Mathis

[57] ABSTRACT

An opening arrangement for packing containers made from laminated layers of plastics and paper wherein a weakening line is arranged in the wall structure of the container and defines an openable part that extends over an edge line forming the junction between a top and side wall. The weakening line is sealed off from the inside of the container by a cover layer impervious to liquid and which is joined to the inside of the container wall around the weakening line, and a strip of flexible material is located between the container wall and cover layer in such manner that it extends over the edge line to thereby provide a good pouring edge.

7 Claims, 2 Drawing Figures

OPENING ARRANGEMENT FOR PACKING CONTAINERS

The present invention relates to an opening arrangement for packing containers of the type in which a weakening line, arranged in the container wall, defines an openable part which extends over an edge line of the container, which weakening line is sealed off the inside of the container by means of a cover layer which is impervious to liquid and which is joined to the inside of the container wall around the weakening line.

Opening arrangements of the abovementioned type are known and are used, inter alia in packing containers for liquid food, e.g. milk. These packing containers are made by the folding and sealing of material in the form of a web or sheet which is laminated and comprises layers of plastics and paper. The opening arrangement is already made when the material is still in the form of a web (the term web will be used in the following to include also sheetlike material) and comprises a weakening line, e.g. in the form of a perforation which wholly or partly defines an openable part of the packing material. To prevent the contents from leaking out through the perforation line, this perforation line is shielded from the contents by means of a cover strip which is applied to that side of the packing material which subsequently will be facing towards the contents. The cover strip covers the perforation line as well as the part of the packing material that can be ripped off and is joined to the packing material along its outer edge. A central area of the cover strip is also joined to the openable part of the packing material, as a result of which the latter, when the package is to be opened and the openable part is being ripped up, will remove also the central portion of the cover strip, so that an opening (or a number of openings) is formed, through which the contents can be emptied out of the package. To facilitate pouring the opening arrangement is located near one of the edges which define the top side of the packing container. In spite of this, however, the known opening arrangement gives rise to certain difficulties when pouring, especially when the package is completely filled. This is so partly because the emptying opening ripped up in the cover strip is badly defined and has uneven edges, partly because no real pouring edge is present but the contents run out on the outside of the package and follow the same. One manner of reducing these disadvantages consists in placing the opening arrangement so that it extends partially outside the top side of the packing container, that is to say continue the opening arrangement a little up to and by the sides which adjoin the top side of the packing container, but this design also does not give the desired good pouring properties.

It is a purpose of the present invention to provide an opening arrangement which is not affected by the abovementioned disadvantages.

It is a further object of the present invention to provide an opening arrangement which after opening presents an appropriate pouring edge.

It is a further object of the present invention to provide an opening arrangement which is simple to manufacture.

These objects have been achieved in accordance with the invention in that an opening arrangement of the type described in the beginning has been given the characteristic that a flexible material strip is so located between the container wall and cover layer that it extends over the edge line of the packing container.

A further object of the present invention, namely to provide an opening arrangement which after the opening offers an emptying opening with well-defined edge line, is obtained in that a preferred embodiment of the opening arrangement has been given the further characteristic that the material strip has an opening located at some distance from the edge line of the packing container, and that the portion surrounding the opening of the material strip is joined to the cover layer.

A preferred embodiment of the invention will be described in detail in the following with reference to the enclosed drawing which schematically shows the opening arrangement in accordance with the invention.

Figure 1:
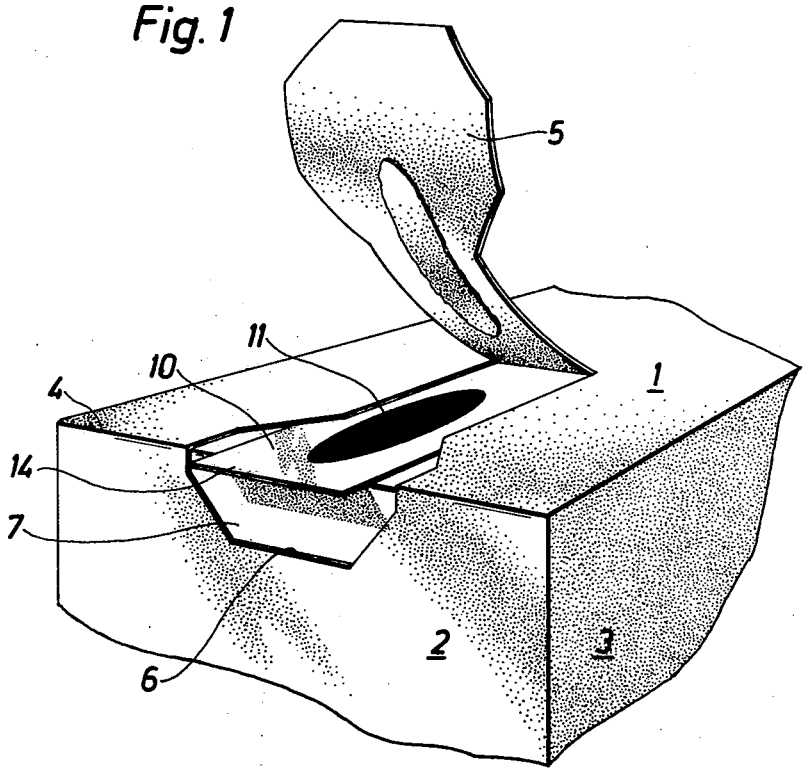
FIG. 1 shows in perspective a part of a packing container with an opening arrangement in accordance with the invention in opened condition.

An upper part of a packing container with an opening arrangement in accordance with the invention is shown in FIG. 1. The opening arrangement in accordance with the invention can be applied to packing containers of a number of different types, but the packing container that is shown in parallelepipedic and comprises a plane upper end surface 1 and four side surfaces or walls extending substantially at a right angle to this upper surface 1, of which only side surfaces 2 and 3 are visible in FIG. 1. The packing container is made of a laminated carton forming material, which comprises a carrier layer of paper, provided on both sides with layers of plastic material which are impervious to liquid.

Figure 2:
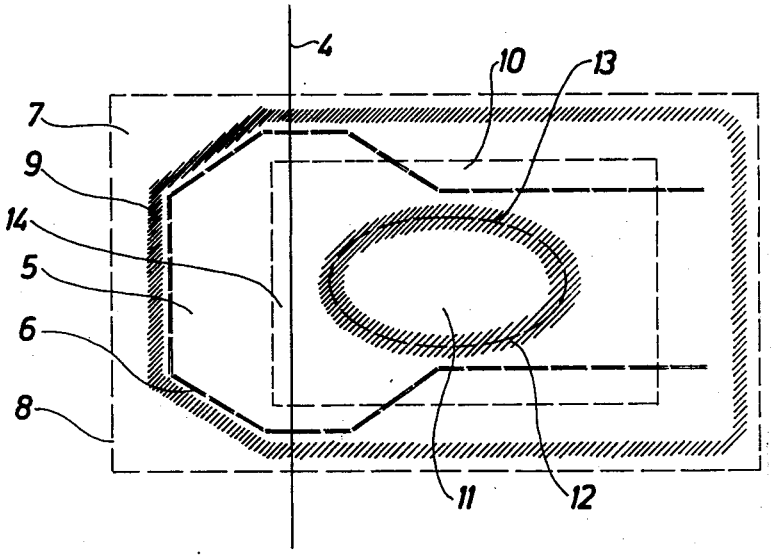
FIG. 2 shows schematically and in plan view a part of a material web with an opening arrangement in accordance with the invention.

The opening arrangement in accordance with the invention is located for the greater part in the top end surface 1 of the packing container, but extends also partially over an edge line 4 between the surfaces 1 and 2 and onto the side surface 2 of the package. The opening arrangement is shown in opened condition in FIG. 1 and comprises an openable part or lug 5 which constitutes an integral part of the material of the packing container, but which is delimited by means of a weakening or perforation line 6 (visible in FIG. 2 in unbroken state) which extends through all the material layers. The weakening line 6 forms a substantially U-shaped figure on the material surface of the packing container. Both the legs of the U-shaped figure are on the top end surface of the package, whilst the part of the weakening line 6 which forms the bottom portion of the U crosses the edge line 4 and is present on the side surface 2 of the packing container. The openable part 5, formed by the weakening or perforation line 6, is thus connected by a non-perforated part with the top end surface of the packing container, whilst its openable front end (which in the following will only be referred to as the end of the openable part) is situated on the side surface 2. In the embodiment shown in the figure, the end of the openable part has a greater width than the remaining parts of the openable part, the reason for which will be explained in the following.

To prevent the contents present in the packing container from leaking out through the perforation holes in the weakening line 6, a cover layer 7 is provided underneath the openable part 5. The cover layer 7 consists of a strip of suitable plastic film and is joined to the inside of the laminated packing material (that is to say the side of the package laminate facing towards the inside of the package) in a continuous sealing zone (FIG. 2), which extends between the edge line 8 of the cover layer 7 and the perforation line 6. Since the cover layer as well as the seal are impervious to liquids, it is prevented that the contents might get close to or leak out from perforations in the weakening line 6, or conversely that air might penetrate into the package.

In accordance with the invention the opening arrangement further comprises a flexible material strip 10. The material strip 10 is situated between the cover layer 7 and the packing laminate and is within the sealing zone 9 in which the cover layer 7 is joined to the packing container laminate. The main part of the flexible material strip 10 is situated underneath of and extends parallel with the top end surface 1 of the packing container, whilst a front end of the material strip 10 extends a little outside (2–4 mm) the edge line 4 which forms the boundary between the top end surface 1 of the packing container and the side surface 2. The width of the flexible material strip 10 is chosen so that the strip is narrower than the wide end of the openable part 5, but wider than the rest of the openable part. Finally, the material strip 10 is manufactured of a flexible, resilient and relatively stiff plastic material which after deformation or folding directly reassumes its original form.

To make possible the pouring out of the contents present in the package after breaking up the weakening line 6 and folding up of the openable part 5, the material strip 10 is provided with a substantially oval pouring opening 11 which is situated in the top end surface 1 of the packing container at a little distance inside the edge line 4. By the folding up of the openable part 5 the pouring opening 11 is revealed, but any passage of the contents through the pouring opening 11 continues to be prevented by the cover layer 7 which is of course undamaged and does not correspond to the pouring opening 11. The cover layer 7 can of course be broken by means of perforating the pouring opening with the help of any suitable sharp object, but so as to allow the packing container to be opened in one single action, the cover layer 7 is sealed to the underside of the openable part 5 in a second sealing zone 12 which extends around the periphery of the pouring opening 11 directly inside the edge line 13 defining the pouring opening 11. In a preferred embodiment the sealing zone has such a width that it also extends beyond the edge line 13, as a result of which, in one and the same sealing, the cover layer 7 is sealed on the one hand to the openable part 5 within the edge line 13, and it is sealed on the other hand to the flexible material strip 10 directly outside the edge line 13, which prevents moreover that the contents during pouring could penetrate between the cover layer 7 and the flexible material strip 10 at the edge line 13. The sealing between the openable part 5 and the cover layer 7 in the sealing zone 12 has the consequence that a portion of the cover layer 7 which in shape and size corresponds to the pouring opening 11 is detached and accompanies the openable part 5 upwards when the packing container is opened. Owing to the placing of the flexible material strip 10 between the cover layer 7 and the openable part 5, the edge line 13 of the pouring opening 11 will serve as a counter-support or tearing edge, so that the opening formed in the cover layer 7 obtains an oval shape corresponding to the pouring opening 11 in strip 10 with well-defined edge line.

Instead of the two separate sealing zones 9 and 12, it is possible to provide a continuous sealing zone, which can be brought about in that the portions of the two sealing zones 9 and 12, which face towards the centre of the package top 1, are "opened" and joined to one another so that the sealing zone produced forms the outer and inner contours of a "U". This can bring certain advantages from a point of view of manufacture, inasmuch as it will make it easier to handle the cover layer 7 and strip 10 during the application and sealing.

As mentioned previously, the flexible material strip 10 extends with a front end 14 over the edge 4. This means that when a packing container, provided with the opening arrangement in accordance with the invention is ready-shaped and unopened, the flexible material strip 10 will be folded along the edge line 4, so that the front part 14 of the strip 10 extends parallel with the side wall 2 of the packing container. When the opening arrangement is opened by the perforation 6 being broken and the openable part 5 being pulled upwards, the front end 14 of the material strip 10, owing to its inherent resilience and elasticity, will spring upwards, so that it will be in the same plane as the main part of the strip 10 and thus form a pouring edge which extends a little beyond the edge line 4 of the packing container. This means that on pouring the contents of the packing container, an even and concentrated flow is obtained, which does not show any tendency whatever of following the outside of the packing laminate over the edge line 4 and along the side surface 2, as is the case in the previously known opening arrangements of the type described in the beginning. To safe-guard the function described it is essential that the material strip 10 should be made of a suitably flexible resilient and elastic material of sufficient stiffness. Suitable materials have proved to be acrylonitrile-butadiene-styrene, polyvinyl chloride or polystyrene, which all give a strip which, by and large, completely reassumes its plane form after folding. A further suitable material was found to be foamed high density polyethylene. A strip made of foamed high-density polyethylene must have a greater thickness, however, than strips made of acrylonitrile-butadiene-styrene or PVC, and may be about 0.2 mm to provide a strip with the desired properties.

The special design of the openable part, with one end being wider than the rest of the openable part and a gradual transition zone between the wide and the narrow part, serves two objects. In the first place it makes it possible that the front part 14 of the material strip 10 after the opening of the openable part 5 can spring freely and unhindered outwards to its desired position at the same time as the rest of the edge line of the material strip 10 is covered by the packing material in the top end surface 1 of the packing container, which gives a well-functioning and aesthetically attractive opening arrangement. Secondly, it has been found that the openable part 5, during the actual moment of opening, when it is successively folded or pulled upwards and backwards, is given a certain corrugation or creasing, which leads to the openable part 5, after the opening, being somewhat shorter than its original length and consequently also somewhat shorter than the clearance left in the packing container material. On re-closing of the packing container, that is to say, folding down of the openable part into the clearance the oblique portions of the weakening line 6, which form the gradual transition zone between the wide and narrow portion of the opening will firmly engage into the corresponding portions of the openable part 5, so that the openable part 5 after pressing down into the clearance will engage the same and be retained substantially flush with the top end surface 1 of the packing container.

The manufacture of the opening arrangement in accordance with the invention takes place in that the packing material web is provided at uniform intervals, whose length corresponds to the material length for each package, with the U-shaped weakening line by perforation with the help of a suitable punching tool. Subsequently the packing material web is provided at each place of perforation with the cover layer and the flexible material strip, which are joined to one another in advance and are supplied in the form of a band of cover layer material, on which band the material strips provided with pouring openings are fixed at uniform intervals. After cutting up into separate units and application to the underside of the packing material web by heat-sealing in the two sealing zones, the manufacture of the opening arrangement is complete and the packing material can be converted to individual packages.

The opening arrangement in accordance with the invention makes it possible in a simple manner to obtain on the one hand an emptying opening with well-defined edge line, on the other hand an appropriate pouring edge which after the opening extends beyond the edge line of the packing container. By the utilization of two different materials, each one of which has optimum properties for its purpose, the hitherto impossible combination of easy tearability of the material layer covering the emptying opening and a stiff pouring edge has been achieved.

I claim:

1. In a packing container having a first wall and a second wall intersecting along an edge, an opening arrangement comprising a plurality of layers of sheet material, the outer layer having a weakening line extending across said first wall and over said edge and along said second wall in the shape of a lug hinged on said first wall, a cover layer on the interior of the container, and a flexible, resilient, normally flat strip interposed between said outer layer and said cover layer, said strip having a pouring opening therein positioned in said first wall and underlying said lug, said strip projecting over said edge, and seal means between said layers for preventing the discharge of the contents of said container except through said pouring opening when said lug is torn away from said walls along said weakening line.

2. A packing container as claimed in claim 1 wherein said flexible, resilient strip is composed of acrylonitrile-butadiene styrene.

3. A packing container as claimed in claim 1 wherein said flexible, resilient strip is composed of polyvinyl chloride.

4. A packing container as claimed in claim 1 wherein said flexible, resilient strip is composed of foamed high-density polyethylene and has a thickness of substantially 0.2 mm.

5. A packing container as claimed in claim 1 wherein the weakening line is substantially U-shaped with the ends of the line being disposed on the upper end surface of the container spaced and closer together than the side of said flexible, resilient strip and wherein the intermediate portion of the U-shaped weakening line is wider apart than the ends of the line and the sides of the flexible, resilient strip.

6. A packing container as claimed in claim 5 wherein the connecting portions of the weakening line between the ends of the legs and the intermediate portion comprise gradual transitions.

7. A packing container according to claim 1 wherein said seal means includes means bonding said cover layer in said opening to said lug whereby said cover layer is removed from said opening simultaneously with opening said lug.

* * * * *